US005598832A

United States Patent [19]

Aoki

[11] Patent Number: 5,598,832

[45] Date of Patent: Feb. 4, 1997

[54] METHOD AND APPARATUS FOR CUTTING STONE BASED MATERIAL

[75] Inventor: Hisaaki Aoki, Ibaraki, Japan

[73] Assignee: New Man International Co., Ltd., Shimodate, Japan

[21] Appl. No.: 211,628

[22] PCT Filed: Aug. 30, 1993

[86] PCT No.: PCT/JP93/01216

§ 371 Date: Aug. 18, 1994

§ 102(e) Date: Aug. 18, 1994

[87] PCT Pub. No.: WO94/05476

PCT Pub. Date: Mar. 17, 1994

[51] Int. Cl.[6] ..... B28D 1/00

[52] U.S. Cl. ..... 125/23.01; 125/36

[58] Field of Search ..... 125/23.01, 36, 125/40; 83/533, 542

[56] References Cited

U.S. PATENT DOCUMENTS

| | | | |
|---|---|---|---|
| 2,778,354 | 1/1957 | Crowl | 125/23.01 |

FOREIGN PATENT DOCUMENTS

| | | | |
|---|---|---|---|
| 2333623 | 7/1977 | France | 125/23.01 |
| 3418302 | 11/1985 | Germany | 125/23.01 |
| 432114 | 2/1949 | Italy | 125/23.01 |
| 60-180808 | 9/1985 | Japan . | |

*Primary Examiner*—M. Rachuba

*Attorney, Agent, or Firm*—Armstrong, Westerman, Hattori, McLeland & Naughton

[57] ABSTRACT

The present invention is concerned with a method and an apparatus for cutting a stone based material of which product can conveniently be used in the form of a tile or the like employable for constructing a walking road, a building floor, a building wall or the like.

First, a lower elastic plate having a lower cutting wire formed thereon to exhibit a desired contour is placed on a platform for the cutting apparatus at a predetermined position, and thereafter, a stone based material to be cut is placed on the lower cutting wire of the lower elastic plate. Subsequently, an upper elastic plate having an upper cutting wire formed thereon to exhibit the same or the substantially same contour as that of the lower cutting wire is fixed to the moving part of a press section for the cutting apparatus at a predetermined position positionally coincident with the foregoing predetermined position on the lower elastic plate. The cutting apparatus includes a press section, a pump unit and an electrical control panel as essential components, and an upper protective plate and a lower plate each having a same cutting protuberance formed thereon are detachably secured to upper and lower protective plates. With the method and the apparatus constructed in the above-described manner, each stone based material can exactly be cut so as to provide a single or a plurality of cut products each having a desired contour.

28 Claims, 11 Drawing Sheets

METHOD AND APPARATUS FOR CUTTING STONE BASED MATERIAL

TECHNICAL FIELD

The present invention relates to improvement of a method and an apparatus for cutting a stone based material of which cut product can conveniently be used for constructing a walking road, a building floor, a building wall or the like.

BACKGROUND ART

A stone based material has been heretofore cut by employing a conventional cutting method as typically shown in FIG. 6, FIG. 7 and FIG. 8. Specifically, FIG. 6 shows a conventional method of cutting a stone based material 4 by ejecting a high pressure water stream 8 having abrasive particles contained therein toward the stone based material 4, FIG. 7 shows a convectional method of cutting a stone based material 4 by reciprocably displacing a cutting wire 9 having diamond particles adhesively secured thereto in the leftward/rightward direction as represented by arrow marks while ejecting a water stream toward the cutting wire 9, and FIG. 8 shows a conventional method of cutting a stone based material 4 by rotating a rotary cutting blade 10 having diamond particles involved therein while ejecting a water stream 11 toward the outer periphery of the rotary cutting blade 10.

However, the conventional method of cutting a stone based material 4 by ejecting the high pressure water stream 8 having abrasive particles contained therein as shown in FIG. 6 has a drawback that each cutting operation is achieved at an increased cost. In addition, another conventional cutting method shown in FIG. 10 has drawbacks that an upper cut part 13 of a stone based material 4 formed by ejecting a high pressure water stream toward the stone base material 4 has an increased width but a lower cut part of the same has a reduced width, causing each cutting operation to be irregularly achieved across the cut plane of the stone based material 4, and moreover, stone particles are scattered away from the stone based material 4.

In addition, the conventional method of cutting a stone based material 4 by reciprocably displacing the cutting wire 9 having diamond particles adhesively secured thereto as shown in FIG. 7 has a drawback that each cutting operation is achieved at an increased cost in the same manner as the conventional cutting method having a high pressure water stream employed therefor. Another drawback is that a cut plane 12 on the stone based material 4 has some ruggedness as typically illustrated in FIG. 9.

Additionally, the conventional method of cutting a stone based material 4 by rotating the rotary cutting blade 10 while ejecting the water stream 11 toward the outer periphery of the rotary cutting blade 10 has drawbacks that each cutting operation is achieved at an increased cost due to the adhesive securing of diamond particles to the rotary cutting blade 10, and moreover, a large quantity of waste water having stone particles contained therein flows outside of the cut stone based material 4, causing a problem of public pollution to arise due to outflow of the waste water containing stone particles therein. Another drawback is that it is practically impossible to cut a number of stone based materials within a short period of time on the mass production basis by employing the conventional cutting method.

DISCLOSURE OF THE INVENTION

The present invention has been made in consideration of the aforementioned drawbacks inherent to the conventional cutting methods.

An object of the present invention is to provide a method of cutting a stone based material wherein the method assures that each cutting operation is accurately achieved at a reduced running cost so as to provide a single or a plurality of products each made of a stone based material.

Another object of the present invention is to provide an apparatus for cutting a stone based material wherein the apparatus is reliably operated by employing a cutting method of the foregoing type.

According to one aspect of the present invention, there is provided a method of cutting a stone based material, wherein the method is characterized in that the method comprises a step of placing on a platform a lower elastic plate having a lower cutting protuberance formed thereon at a predetermined position, the lower cutting protuberance being formed to exhibit a desired contour, a step of placing on the lower elastic plate a stone based material to be cut, a step of fixing an upper elastic plate having an upper cutting protuberance formed thereon to the moving part of a press machine at a predetermined position positionally coincident with the foregoing predetermined position, the upper cutting protuberance being formed to exhibit the same or the substantially same contour as that of the lower cutting protuberance of the upper elastic plate, and a step of operating the press machine so as to cut the stone based material by bringing the upper cutting protuberance of the upper elastic plate in compressing contact with the lower cutting protuberance of the lower elastic plate.

In addition, according to other aspect of the present invention, there is provided an apparatus for cutting a stone based material wherein the apparatus includes a press section, a pump unit and an electric control panel as essential components, wherein the apparatus is characterized in that a lower cutting plate having a lower cutting protuberance formed thereon to exhibit a desired contour is removably secured to a lower protective plate for the lower cutting plate, and an upper cutting plate having an upper cutting protuberance formed thereon to exhibit the same or the substantially same contour as that of the lower cutting protuberance of the lower elastic plate is removably secured to an upper protective plate for the upper cutting plate.

Usually, the lower cutting protuberance and the upper cutting protuberance exhibit a square contour, respectively.

Similarly, the lower cutting protuberance and the upper cutting protuberance usually exhibit a circular contour, respectively.

The lower cutting protuberance and the upper cutting protuberance may exhibit a rhombic contour in conformity with a customer's request, respectively.

Similarly, the lower cutting protuberance and the upper cutting protuberance may exhibit an elliptical contour in conformity with a customer's request, respectively.

Similarly, the lower cutting protuberance and the upper cutting protuberance may exhibit a bird-like contour in conformity with a customer's request, respectively.

Similarly, the lower cutting protuberance and the upper cutting protuberance may exhibit a sector-like contour in conformity with a customer request, respectively.

Similarly, the lower cutting protuberance and the upper cutting protuberance may exhibit a wavy elongated rectangular contour in conformity with a customer's request, respectively.

Similarly, the lower cutting protuberance and the upper cutting protuberance may exhibit an octagonal contour in conformity with a customer's request, respectively.

Similarly, the lower cutting protuberance and the upper cutting protuberance may exhibit a hexagonal contour in conformity with a customer's request, respectively.

In addition, a plurality of lower cutting protuberances and a plurality of upper cutting protuberances each having a contour same to or different from each other may be formed on the lower elastic plate and the upper elastic plate.

Other objects, features and advantages of the present invention will become apparent from reading of the following description which has been made in conjunction with the accompanying drawings.

BEST MODE FOR CARRYING THE INVENTION

The present invention will now be described in detail hereinafter with reference to the accompanying drawings which illustrate preferred embodiments thereof.

Figure 1:
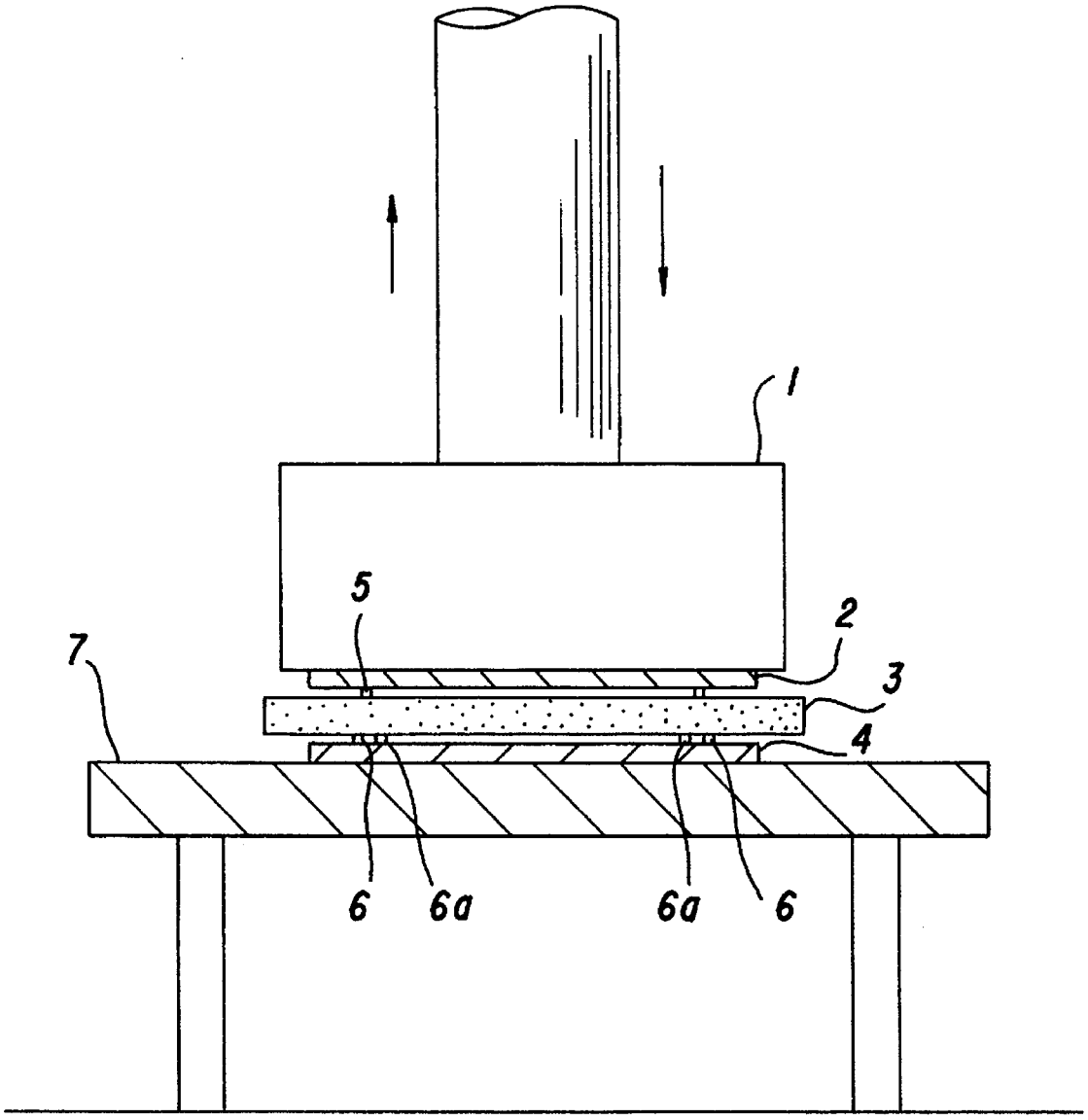
FIG. 1 is a partially exploded vertical sectional view which shows an apparatus for cutting a stone based material according to an embodiment of the present invention.

FIG. 1 is a partially exploded vertical sectional view of an apparatus for cutting a stone based material according to an embodiment of the present invention. In the drawing, reference numeral 7 designates a platform of the cutting apparatus. A lower elastic plate 4 having a positional mark for a lower cutting wire 6 printed thereon is placed on the platform 7 at a predetermined position, and the lower cutting wire 6 is then placed on the foregoing positional mark printed therefor on the lower elastic plate 4. Thereafter, a stone based material 3 is placed on the lower cutting wire 6, an upper cutting wire 5 having the same contour as that of the lower cutting wire 6 or a contour appreciably larger or smaller than that of the lower cutting wire 6 is placed on the stone based material 3, and subsequently, an upper elastic plate 2 is placed on the upper cutting wire 5. Thereafter, when a press machine 1 is operated to thrust the upper elastic plate 2 from above, the stone base material 3 is cut by the upper cutting wire 5 in cooperation with the lower cutting wire 6 within a very short period of time to provide a product of stone based material having a contour corresponding to that of each of both the upper and lower cutting wires 5 and 6. A size, a contour and a position of each of the upper cutting wire 5 and the lower cutting wire 6 may be determined in a different manner as will be described later.

Alternatively, each of the upper cutting wire 5 and the lower cutting wire 6 is designed to have a same contour and a same size, and subsequently, they are located at the same positions on the upper and lower surfaces of a stone based material 3 so as to be cut to a predetermined size. Thereafter, when the press machine 1 is operated to thrust the stone based material 3 via the upper elastic plate 2 and the upper cutting wire 5 from above, the stone based material 3 is cut by the upper cutting wires 5 in cooperation with the lower cutting wire 6 to provide a product of stone based material having a desired contour.

Otherwise, as shown in FIG. 1, a single upper cutting wire 5 is placed on the stone based material 3, and two lower cutting wires 6 and **6*a* are placed on the lower elastic material 4. In this case, it is necessary that the upper cutting wire 5 placed on the stone based material 3 is located between both the lower cutting sires 6 and 6*a* placed on the lower elastic plate 4**.

FIG. 2 to FIG. 5 show by way of plan views the positions to be assumed by the upper and lower cutting wires each designed to exhibit a various kind of contour are printed on the lower elastic plate 4 and the upper elastic plate 2, respectively.

Figure 2:
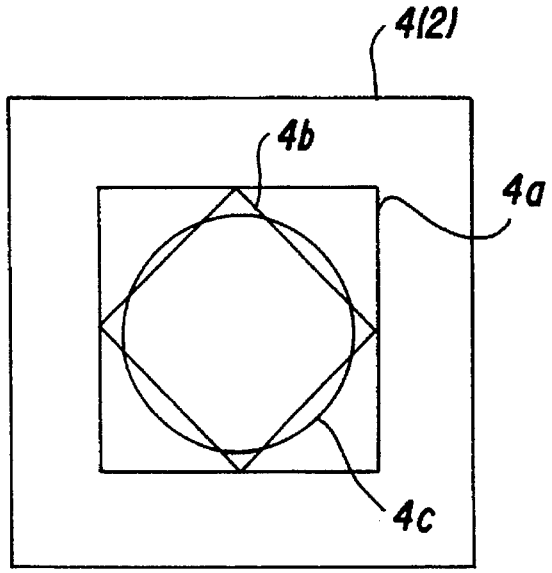
FIG. 2 is a fragmentary plan view of the cutting apparatus, particularly showing the positions where cutting wires each having a different contour are secured to a lower elastic plate and an upper elastic plate.

Specifically, FIG. 2 is a plan view of the lower elastic plate 4 and the upper elastic plate 2 which shows that a position **4*a* for disposing the upper and lower cutting wires each having a square contour, a position 4*b* for disposing the upper and lower cutting wires each having a rhombic contour and a position 4*c* for disposing the upper and lower circular cutting wires each having a circular contour are printed on the lower elastic plate 4 and the upper elastic plate 2. In this case, both the upper and lower cutting wires 5 and 6 each having a predetermined contour are placed on the stone based material 3 and the lower elastic plate 4 at the positions corresponding to the position 4*a*, the position 4*b* or the position 4*c*. Otherwise, both the upper and lower cutting wires 5 and 6 are fixedly secured directly to the upper elastic plate 2 and the lower elastic plate 4** at the foregoing positions.

Figure 3:
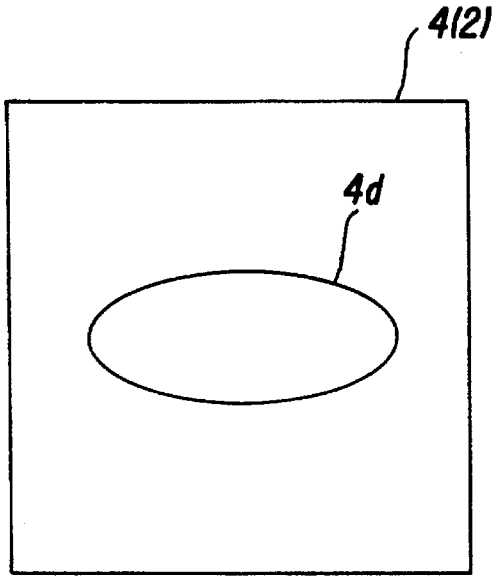
FIG. 3 is a fragmentary plan view of the cutting apparatus, particularly showing the position where elliptical cutting wires are secured to a lower elastic plate and an upper elastic plate.

FIG. 3 is a plan view of the lower elastic plate 4 and the upper elastic plate 2 which shows that the positions to be assumed by the upper and lower cutting wires 5 and 6 each designed to exhibit an elliptical contour are printed on the upper elastic plate 2 and the lower elastic plate 4. In this case, the upper cutting wire 5 and the lower cutting wire 6 each designed to exhibit an elliptical contour are fixedly secured directly to the upper elastic plate 2 and the lower elastic plate 4 at the positions corresponding to a position **4*d*** for disposing an elliptical cutting wire.

Figure 4:
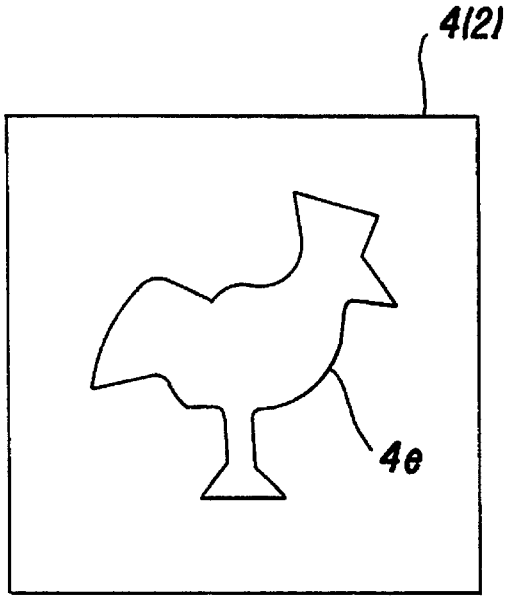
FIG. 4 is a fragmentary plan view of the cutting apparatus, particularly showing the position where cutting wires each having a chicken-like contour are secured to a lower elastic plate and an upper elastic plate.

FIG. 4 is a plan view of the lower elastic plate 4 and the upper elastic plate 2 which shows that the positions to be assumed by the upper and lower cutting wires 5 and 6 each designed to exhibit a chicken-like contour are printed on the upper elastic plate 2 and the lower elastic plate 4. Also in this case, the upper cutting wire 5 and the lower cutting wire 6 each designed to exhibit a chicken-like contour are fixedly secured directly to the upper elastic plate 2 and the lower elastic plate 4.

Figure 5:
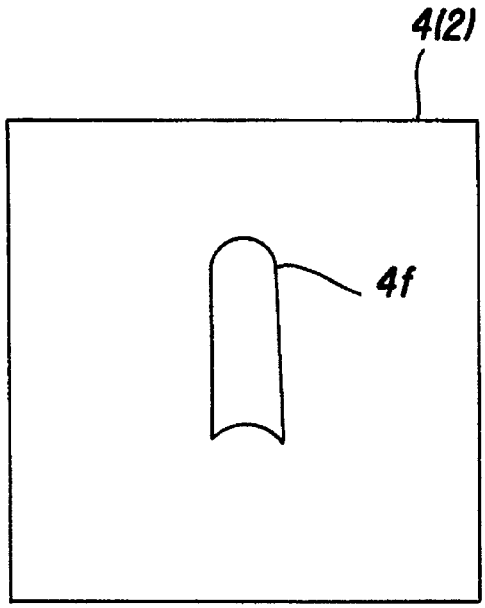
FIG. 5 is a fragmentary plan view of the cutting apparatus, particularly showing the position where reciprocably movable cutting wires each having a bullet-like contour are secured to a lower elastic plate and an upper elastic plate.
Figure 6:
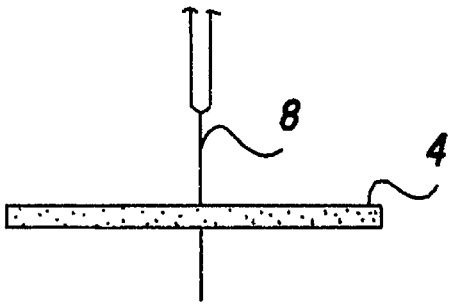
FIG. 6 is an illustrative view which schematically shows a conventional apparatus for cutting a stone based material by using a high pressure water stream.
Figure 7:
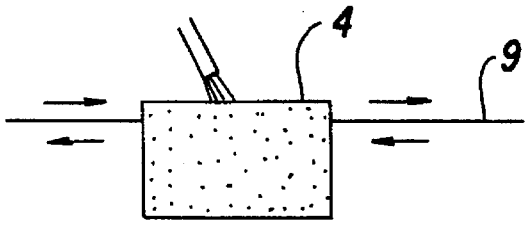
FIG. 7 is an illustrative view which schematically shows a conventional apparatus for cutting a stone based material by using a reciprocably movable cutting wire.
Figure 8:
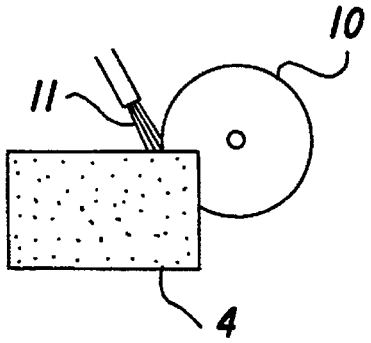
FIG. 8 is an illustrative view which schematically shows a conventional apparatus for cutting a stone based material by using a rotary blade wherein the positions where reciprocably movable cutting wires each having a bullet-like contour are secured to a lower elastic plate and an upper elastic plate are shown in the drawing.
Figure 9:
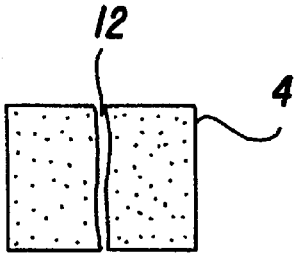
FIG. 9 is an illustrative view which schematically showing by way of sectional view a conventional apparatus for cutting a stone based material by using a reciprocably movable cutting wire.
Figure 10:
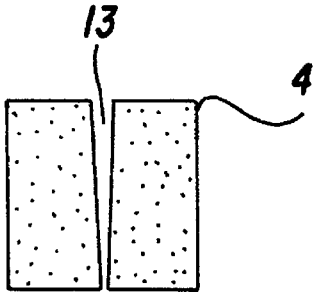
FIG. 10 is an illustrative view which schematically shows a conventional apparatus for cutting a stone based material by using a high pressure water stream.

FIG. 5 is a plan view of the lower elastic plate 4 and the upper elastic plate 2 which shows that the positions to be assumed by the upper and lower cutting wires 5 and 6 each designed to exhibit a bullet-like contour are printed on the upper elastic plate 2 and the lower elastic plate 4. Also in this case, the upper cutting wire 5 and the lower cutting wire 6 each designed to exhibit a bullet-like contour are fixedly secured directly to the upper elastic plate 2 and the lower elastic plate 4.

Figure 11:
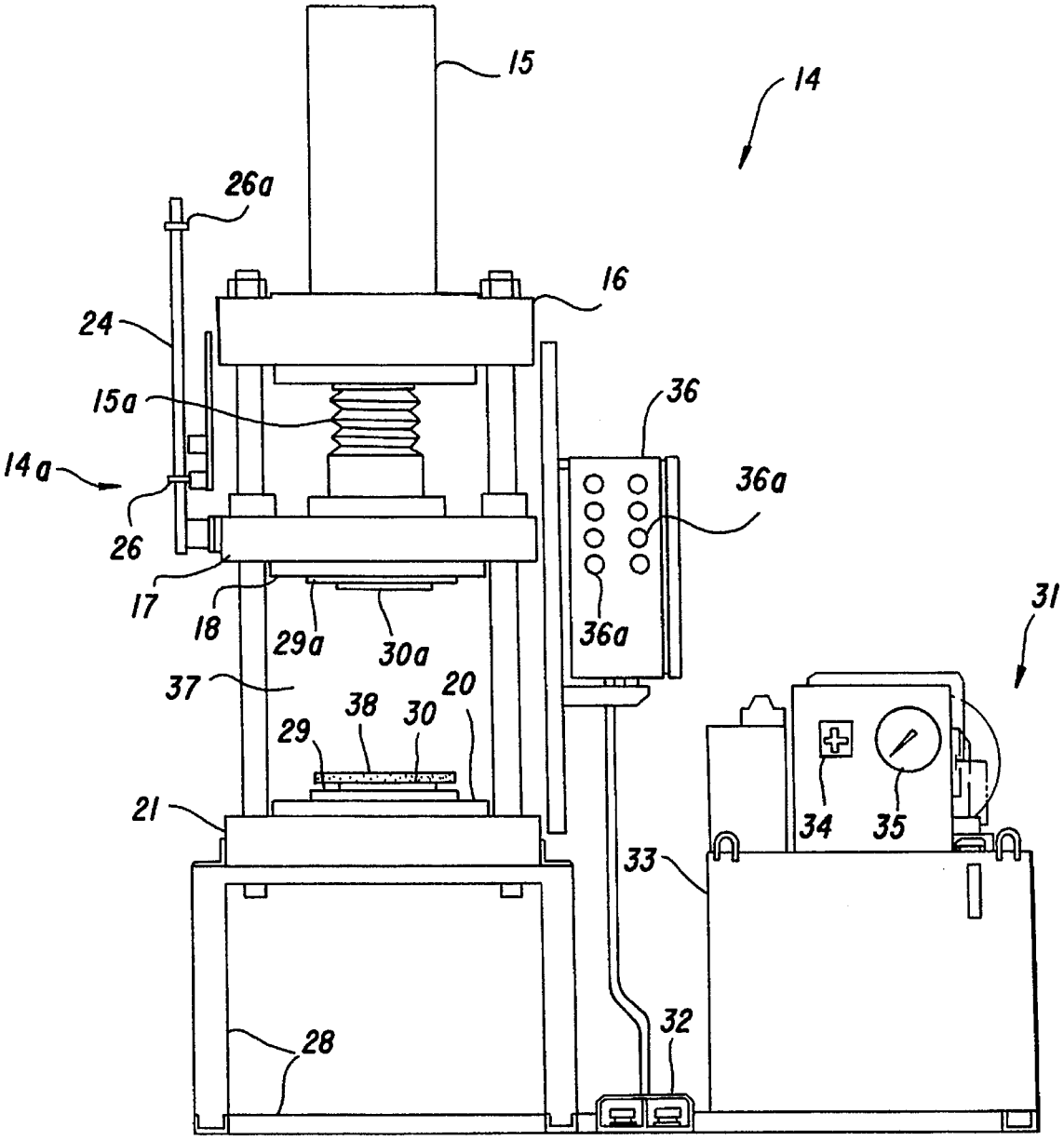
FIG. 11 is a front view of an apparatus for cutting a stone based material according to another embodiment of the present invention.
Figure 12:
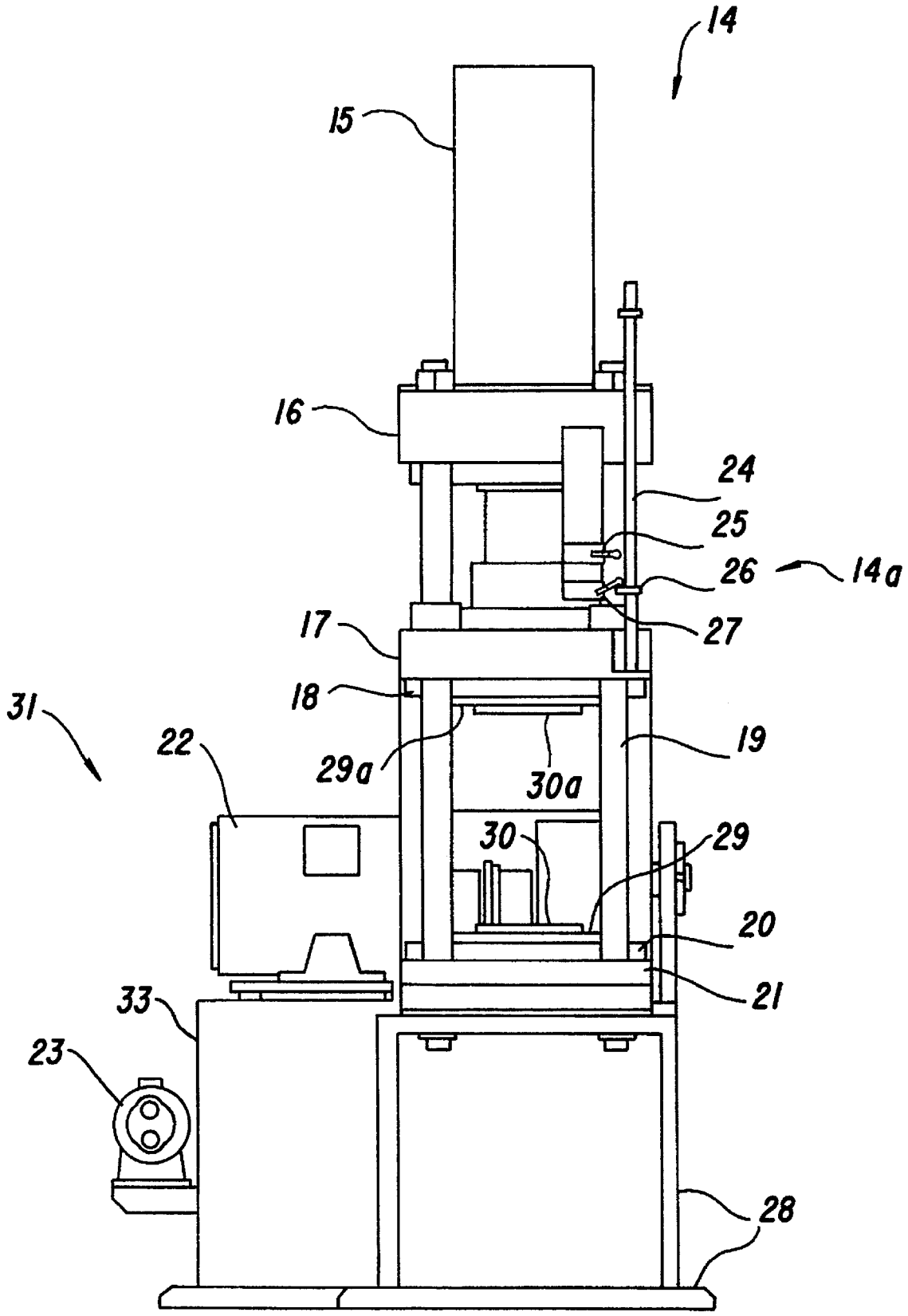
FIG. 12 is a side view of the cutting apparatus shown in FIG. 11.

FIG. 11 is a front view of an apparatus for cutting a stone based material according to another embodiment of the present invention, and FIG. 12 is a side view of the cutting apparatus shown in FIG. 11. The cutting apparatus generally designated by reference numeral 14 is substantially composed of a press section **14*a*, a pump unit 31 and an electric control panel 36**.

A driving motor 22 is mounted on an accommodating case 33 of the pump unit 31 in which devices, instrument and associated components required for driving a pump are accommodated. In addition, a flow rate regulating valve (not shown), a pressure regulating valve 34 and a pressure gauge 35 are arranged on the accommodating case 33, and hydraulic oil is filled in the accommodating case 33.

Alternatively, the flow rate regulating valve (not shown), the pressure regulating valve 34 and the pressure gauge 35 may be arranged directly above the electric control panel 36.

A controlling unit (not shown) is received in the electric control panel 36 in order to electrically control the cutting apparatus 14. In FIG. 11, reference numeral **36*a* designates a plurality of switch buttons. These switch buttons 36*a*** serve to actuate an emergency stop button, a power source switch, a switch for lowering a cylinder, a switch for raising up the cylinder, a normal stop switch, a stroke shifting switch, a hydraulic pump activating switch, a hydraulic pump stopping switch, an automatic activating switch or the like.

Reference numeral 32 designates a foot switch. The foot switch 32 makes it possible to shift the turned-on state to the turned-off state of each of the switches **36*a*, and vice versa merely by depressing the foot switch 32 in order to easily achieve each cutting operation for cutting a stone based material with the cutting apparatus. Reference numeral 15*a* designates a corrugated protective cover. The protective cover 15*a*** prevents the cutting apparatus from being contaminated with oil or other foreign materials due to dropping and adhering of the oil or other foreign materials to the cutting apparatus.

Next, a series of steps of cutting a stone based material with the cutting apparatus constructed in the aforementioned manner will be described below mainly with reference to FIG. 11.

First, a lower cutting plate 29 having a lower cutting protuberance 30 formed thereon is fixedly secured to a lower protective plate 20, while an upper cutting plate **29*a* having the same cutting protuberance 30*a* as the lower cutting protuberance 30 formed thereon is fixedly secured to an upper protective plate 18. The upper protective plate 18 and the lower protective plate 20 are located in such a manner that as the upper cutting plate 19*a* secured to the upper protective plate 18 is lowered, the upper cutting protuberance 30*a* of the upper cutting plate 29*a* is brought in compressing correct contact with the lower cutting protuberance 30 of the lower cutting plate 29 without any positional deviation in the transverse direction. After both the upper and lower cutting plates 29 and 29*a* are fixedly secured to the lower and upper protective plates 18 and 20, a stone base material 38 to be cut is placed on the lower cutting protuberance 30 of the lower cutting plate 29, and subsequently, an operator depresses the foot switch 32 to the ON side with his foot. Thus, as the cylinder 15 is lowered, an upper cutting protuberance 30***a* of the upper cutting plate 29*a* comes in contact with the upper surface of the stone based material 38 to thrust the latter therewith, and at the same time, the stone based material 38 is compressed in cooperation with the lower cutting protuberance 30 on the lower cutting plate 29 not only from above but also from below, resulting in the stone based material 38 being cut in conformity with the contour of both the upper and lower cutting protuberances 30 and 30*a*. After it is confirmed that the stone based material is correctly cut, the operator depresses the foot switch 32 to the OFF side with his foot, causing the piston in the cylinder 15 is raised up, whereby a single cutting operation is completed. A series of cutting operations can successively be performed by repeating the aforementioned steps.

The press section 14*a* is mounted on a platform 28 and includes as essential components a hydraulic cylinder 15, an upper frame 16, a slide 17, a lower frame 21, four columns 19, an upper protective plate 18, a lower protective plate 20, a stroke adjusting rod 24 having an upper limit kicker 26 and a lower limit kicker 26*a* attached thereto, a lower limit switch 25 for imitatively defining a lower limit position of the hydraulic cylinder 15, an upper limit switch 27 for imitatively defining an upper limit position of the same, a lower cutting plate 29, an upper cutting plate 29*a*, a lower cutting protuberance 30, an upper cutting protuberance 30*a*, and an oil cooler 23.

The upper cutting plate 29*a* having the upper cutting protuberance 30*a* formed thereon is detachably secured to the upper protective plate 18 fixedly secured to the lower end of the hydraulic cylinder 15 to be displaced together with the latter, and the lower cutting plate 29 having the same cutting protuberance as the cutting protuberance 29*a* formed thereon is detachably secured to the lower protective plate 20.

When a stone based material 38 is cut, it is inserted into a hollow space 37 defined between the upper cutting plate 29*a* and the lower cutting plate 29, and thereafter, the stone based material 38 is placed on the lower cutting plate 29 having the cutting protuberance 30 formed thereon. Subsequently, the foot switch 32 is turned on by depressing it with an operator's foot, and the hydraulic cylinder 15 having the upper cutting plate 29 detachably secured to the lower end surface thereof is then lowered until the upper cutting protuberance 30*a* on the upper cutting plate 29*a* comes in compressing contact with the upper surface of the stone based material 38, whereby the stone based material 38 can be cut in conformity with the contour defined by both the upper and lower cutting protuberances 30 and 30*a*. FIG. 11 shows the case that the cutting apparatus is equipped with the foot switch 38 which can be actuated with an operator's foot. However, the present invention should not be limited only to the foot switch 32. Alternatively, a switch which can be actuated by an operator's hand may be substituted for the foot switch 38.

Securing of the upper and lower cutting plates 29 and 29*a* to the upper and lower protective plates 18 and 20 is achieved in such a manner that the lower end surface of the upper cutting protuberance 30*a* formed on the upper cutting plate 29*a* is exactly brought in contact with the upper end surface of the lower cutting protuberance 30 formed on the lower cutting plate 29 without any positional deviation relative to each other in the transverse direction when the hydraulic cylinder 15 is lowered. With the cutting apparatus 14 constructed in the above-described manner, the positions to be assumed by the upper and lower cutting protuberances 30*a* and 30 are preliminarily printed on the upper and lower cutting plates 29*a* and 29 secured to the upper and lower protective plates 18 and 20, and the upper and lower cutting plates 20*a* and 29 having the foregoing positions (not shown) printed thereon are secured to the upper and lower protective plates 18 and 20 by tightening bolts (not shown) or using permanent magnets or solenoids (not shown).

FIG. 13 to FIG. 18 are plan views which show a various kind of lower cutting plate 29 to be detachably secured to each of the upper and lower protective plates 18 and 20, respectively.

Figure 13:
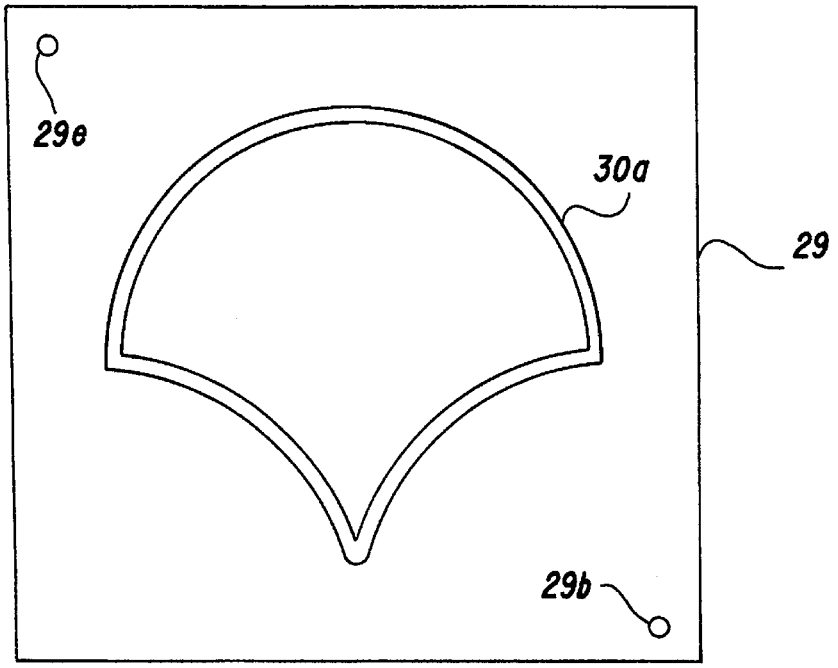
FIG. 13 is a plan view of an elastic cutting plate mounted on the cutting apparatus wherein a cutting protuberance having a sector-like contour is formed on the cutting plate.
Figure 14:
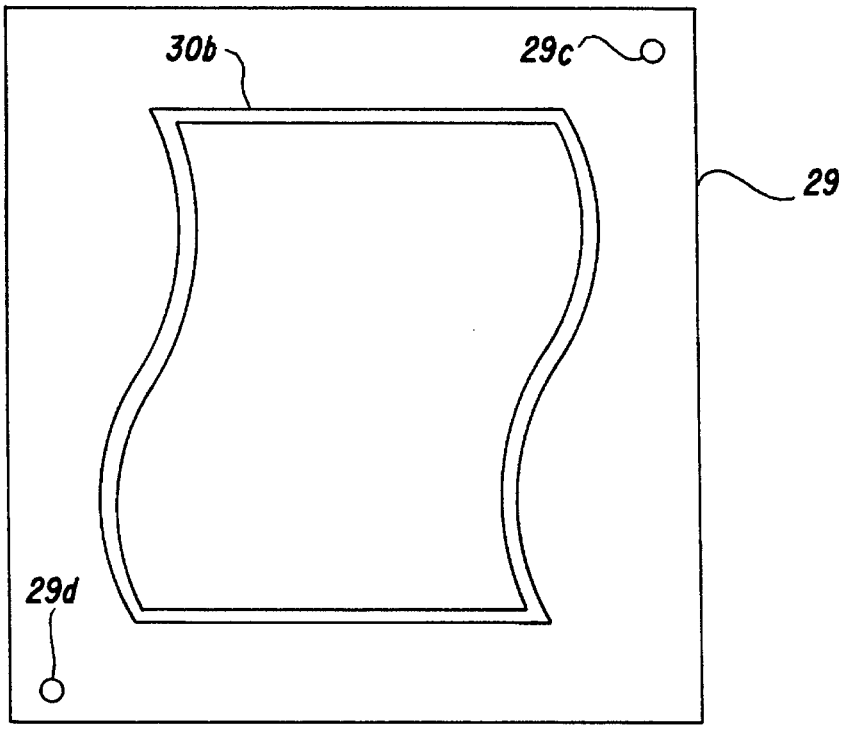
FIG. 14 is a plan view of an elastic cutting plate mounted on the cutting apparatus wherein a cutting protuberance having a wavy elongated rectangular contour is formed on the elastic cutting plate.
Figure 15:
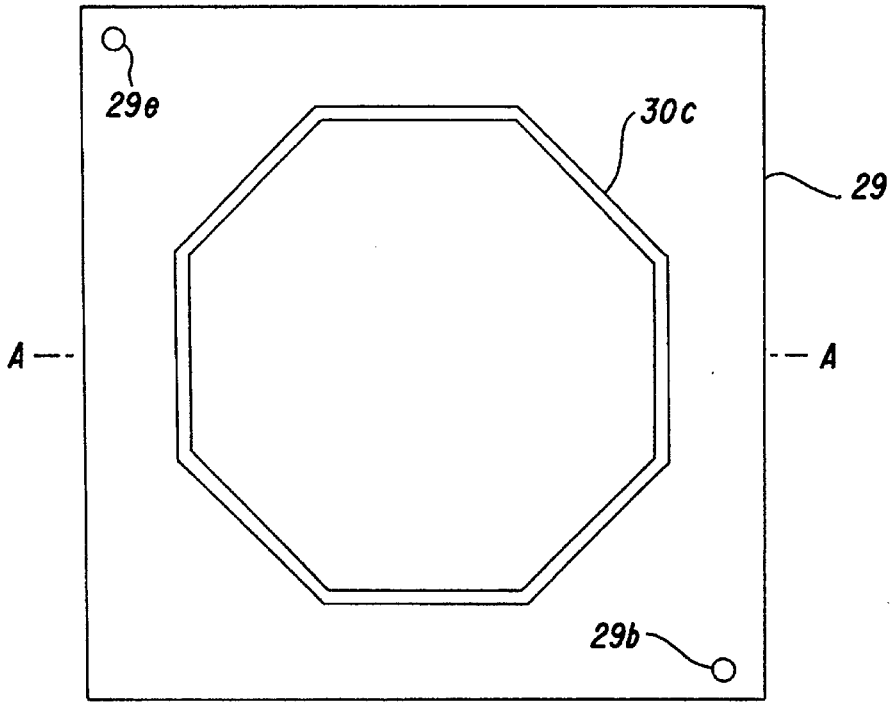
FIG. 15 is an elastic plan view of a cutting plate mounted on the cutting apparatus wherein an octagonal cutting protuberance is formed on the elastic cutting plate.
Figure 16:
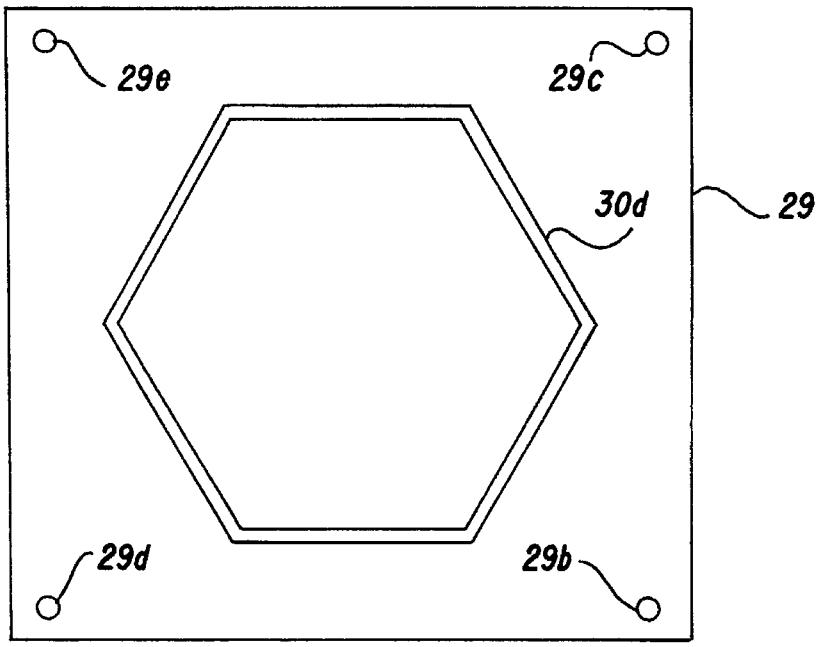
FIG. 16 is a plan view of a cutting plate mounted on the cutting apparatus wherein a hexagonal cutting protuberance is formed on the elastic cutting plate.
Figure 17:
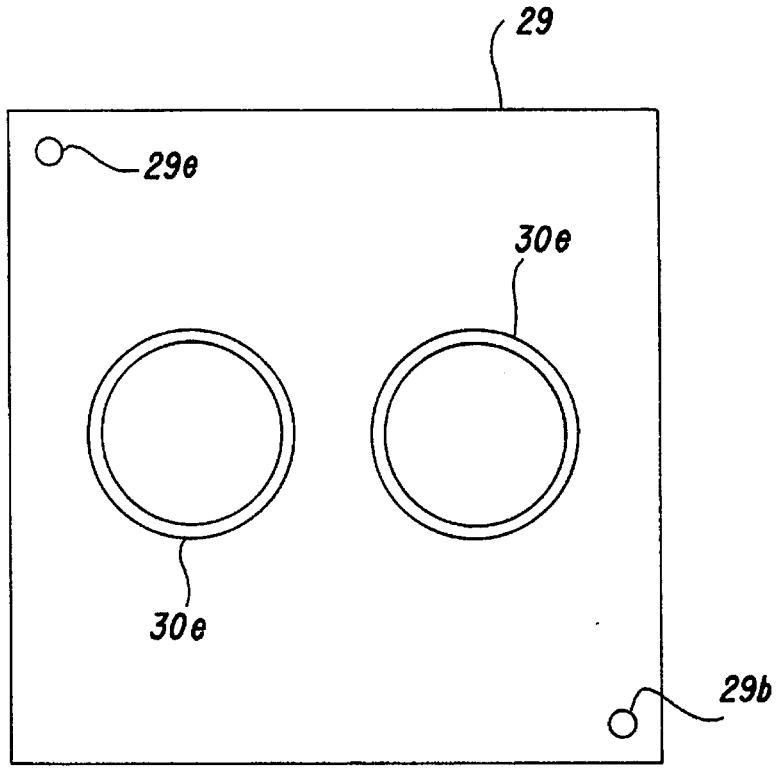
FIG. 17 is a plan view of an elastic cutting plate mounted on the cutting apparatus wherein two circular cutting protuberances each having a same contour are formed on the elastic cutting plate.
Figure 18:
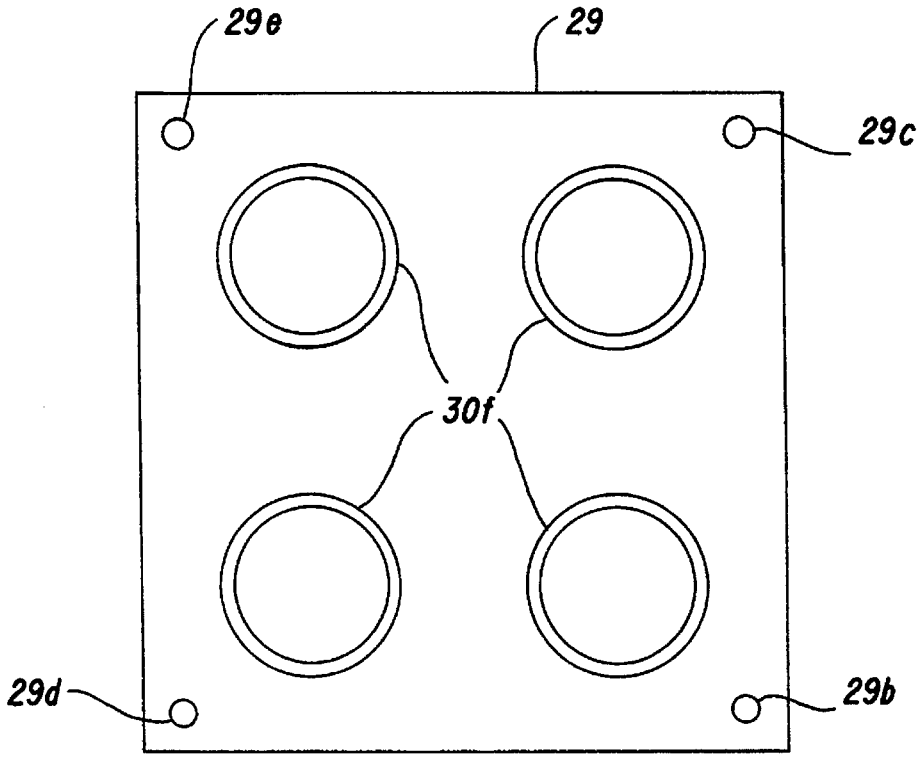
FIG. 18 is a plan view of an elastic cutting plate mounted on the cutting apparatus wherein four circular cutting protuberances each having a same contour are formed on the elastic cutting plate.

Specifically, FIG. 13 shows by way of plan view an example of a lower cutting plate 29 which has a lower cutting protuberance 30*a* having a sector-like contour formed on the upper surface thereof, FIG. 14 shows by way of plan view an example of a lower cutting plate 29 which has a lower cutting protuberance 30*b* having a wavy elongated rectangular contour formed on the upper surface thereof, FIG. 15 shows by way of plan view an example of a lower cutting plate 29 which has a lower cutting protuberance 30*c* having an octagonal contour formed on the upper surface thereof, FIG. 16 shows by way of plan view an example of a lower cutting plate 29 which has a lower cutting protuberance 30*d* having a hexagonal contour formed on the upper surface thereof, FIG. 17 shows by way of plan view an example of a lower cutting plate 29 which has two lower cutting protuberances 30*e* each having a circular contour formed on the upper surface thereof, and FIG. 18 shows by way of plan view an example of a lower cutting plate 29 which has four lower cutting protuberances 30*f* each having a circular contour formed on the upper surface thereof. As shown in FIG. 17 and FIG. 18, a plurality of products each made of a stone based material can be produced merely by performing a single cutting operation under a condition that the position to be assumed by each of a plurality of cutting protuberances each having a same contour are preliminarily printed on the lower cutting plate 29. In FIG. 13 to FIG. 18, reference numerals 29*b*, 29*c*, 29*d* and 29*e* designate bolt insert holes, respectively, through which bolts (not shown) are inserted so as to secure the lower cutting plate 29 or the upper cutting plate 29*a* to the lower protective plate 20 or the upper protective plate 18 by tightening the bolts.

Figure 19:
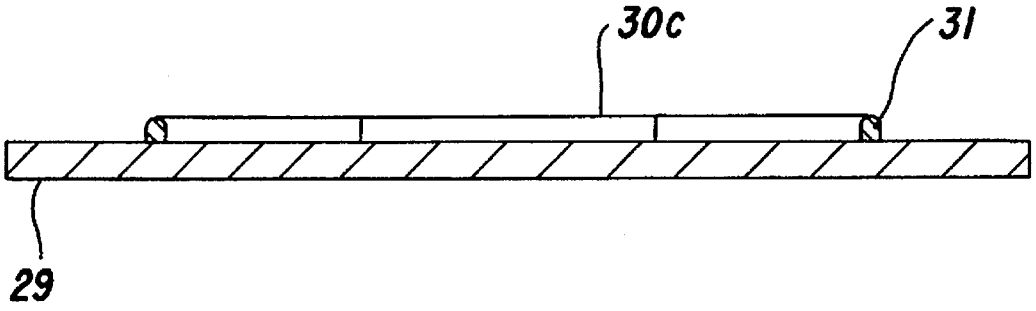
FIG. 19 is a vertical sectional view of a lower elastic cutting plate and a lower cutting protuberance taken along line A—A in FIG. 15 wherein the lower cutting protuberance has a semicircular cross-sectional shape at the upper part thereof.
Figure 20:
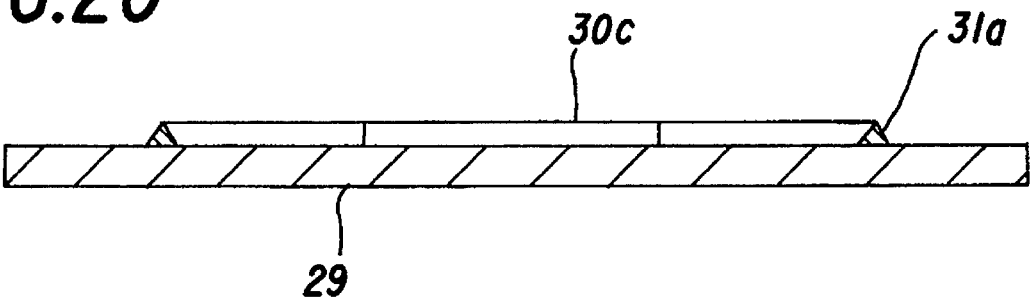
FIG. 20 is a vertical sectional view of the lower cutting plate and the lower cutting protuberance taken along line A—A in FIG. 15 wherein the lower cutting protuberance has a triangular cross-sectional shape.
Figure 21:
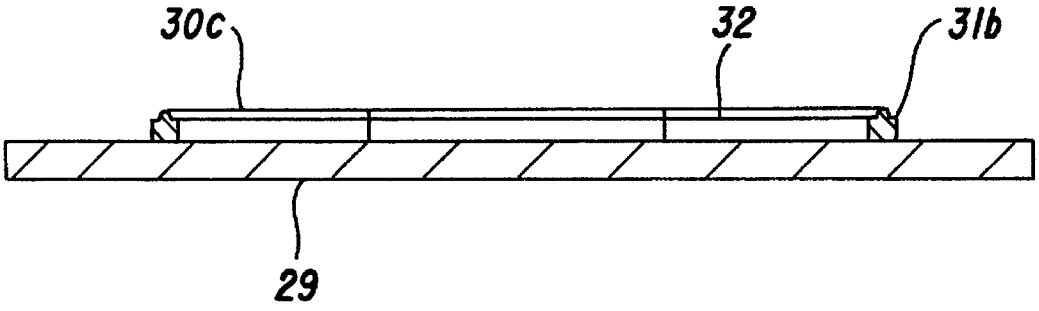
FIG. 21 is a vertical sectional view of the lower cutting plate and the lower cutting protuberance taken along line A—A in FIG. 15 wherein the lower cutting protuberance has a projected cross-sectional shape at the upper part thereof.

FIG. 19 to FIG. 21 are variceal sectional views which show a lower cutting protuberance 30*c* formed on a lower cutting plate 29 with a various kind of cross-sectional contour, respectively. Specifically, FIG. 19 shows by way of vertical sectional view an example of the structure of the lower cutting plate 29 taken along line A—A in FIG. 15 wherein the upper part of a lower cutting protuberance 30*c* formed on the lower cutting protuberance 29 has a semicircular cross-sectional contour, FIG. 20 shows by way of vertical sectional view an example of the structure of a lower cutting protuberance 30*c* having a triangular cross-sectional contour, and FIG. 21 shows by way of vertical sectional view an example of the structure of a lower cutting protuberance 30*c* having a upwardly projected cross-sectional contour at the upper part thereof.

The cutting apparatus 14 constructed according to the present invention is equipped with a pump unit 31 having performances as noted below.

a quantity of hydraulic oil discharged from the hydraulic pump 31

| | |
|---|---|
| high pressure | 6.1 liters/minute |
| low pressure | 36.3 liters/minute |

a hydraulic pressure of the hydraulic oil discharged from the hydraulic pump 31

| | |
|---|---|
| high pressure | 140 kgf/cm$^2$ |
| low pressure | 30 kgf/cm$^2$ |
| an electric motor | 37 KW, 4P, 200 V, 50/60 Hz |

a total quantity of hydraulic oil reserved in the hydraulic pump 31 (inclusive of a capacity of a tank) 200 liters.

In practice, the cutting apparatus 14 was design in three types in such a manner as to generate a compressing power of 20 tons, 50 tons or 100 tons. The type of the cutting apparatus 14 was determined depending on the thickness of a stone based material to be cut.

In addition, the cutting apparatus 14 may be designed in a pneumatic type, a hydraulic type or a mechanical type.

Figure 22:
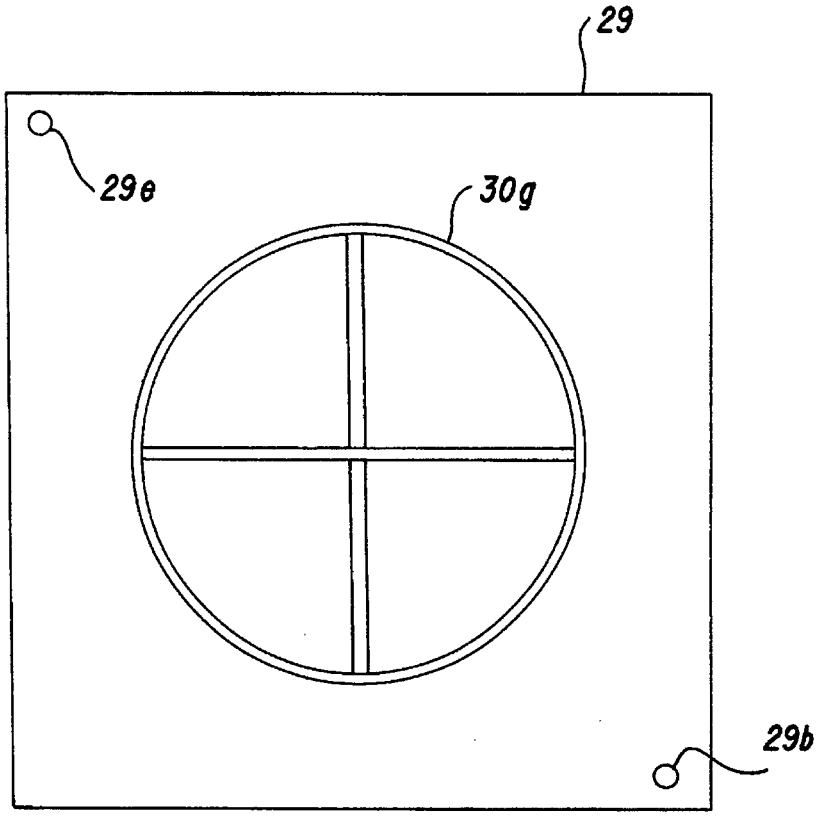
FIG. 22 is a plan view of an elastic cutting plate mounted on the cutting apparatus wherein a cutting protuberance having a circular contour is formed on the elastic cutting plate, and moreover, a cross-shaped cutting protuberance is additionally formed on the elastic cutting plate within the range defined by the circular cutting protuberance.
Figure 23:
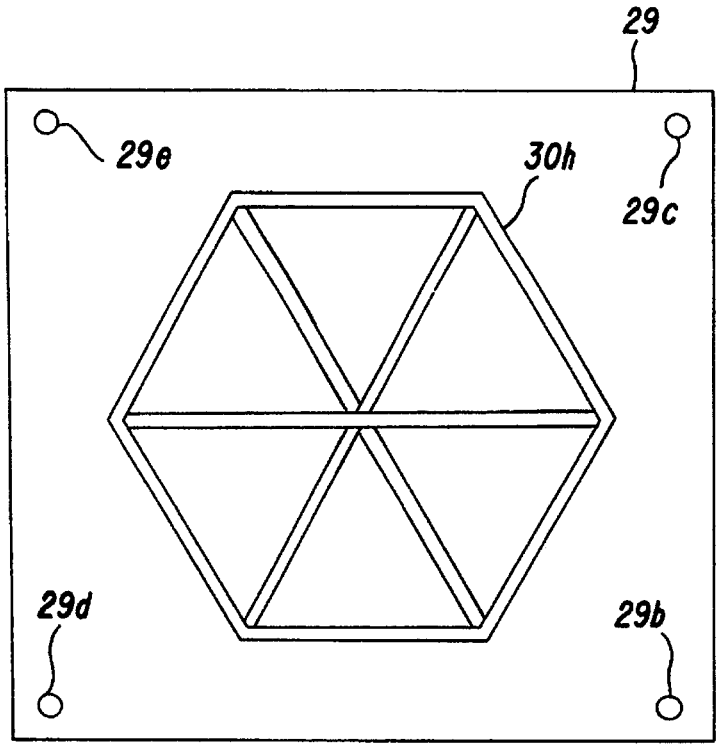
FIG. 23 is a plan view of an elastic cutting plate mounted on the cutting apparatus wherein a cutting protuberance having a hexagonal contour is formed on the elastic cutting plate, and moreover, three diametrically extending cutting protuberances are additionally formed on the cutting plate within the range defined by the hexagonal cutting protuberance.

FIG. 22 and FIG. 23 are plan views which show a lower cutting plate 29 constructed according to further embodiment of the present invention, respectively. Specifically, FIG. 22 shows by way of plan view the lower cutting plate 29 having a circular cutting projection 30*g* formed thereon wherein two additional lower cutting protuberances are formed in a cross-shaped pattern within the range defined by the lower circular cutting protuberance 30*g*, and FIG. 23 shows by way of plan view a lower cutting protuberance 30*h* having a hexagonal cutting protuberance 30*h* formed thereon wherein three additional lower cutting protuberances are diametrically formed within the range defined by the lower cutting protuberance 30*h*.

With such construction, a plurality of products each made of a stone based material with a same contour can be cut by a single compressing operation.

INDUSTRIAL APPLICABILITY

As described above, a method and an apparatus for cutting a stone based material can practically be realized at a low cost by operating a conventional press machine. Since each stone based material is cut by the press machine within a very short period of time, there do not arise malfunctions that stone particles are scattered away at the time of a compressing operation, and moreover, waste water containing stone particles flows away from the press machine because no water is used during the compressing operation.

In addition, after completion of the compressing operation, each product of cut stone based material exhibits substantially flat planes. Since a stone based material can be cut within a very short period of time by operating the press machine, manhours required for performing each compressing operation can substantially be reduced. Consequently, products of cut stone based materials each having a circular contour, an elliptical contour or the like to be used for constructing a walking road, a building floor, a building wall or the like can be obtained at a largely reduced cost.

A conventional cutting operation for obtaining products of cut stone based materials each having a circular contour, an elliptical contour or the like by operating a press machine can be achieved only by a well-trained operator. In contrast with the conventional cutting operation, according to the present invention, each cutting operation can be achieved by an unskilled operator or an operator who has not sufficient experiences.

I claim:

1. A method of cutting a stone based material, comprising the steps of:

placing on a platform a lower elastic plate having a lower cutting wire having a lower cutting protuberance formed thereon at a predetermined position, said lower cutting protuberance being formed to exhibit a desired contour;

placing on said lower elastic plate a stone based material to be cut;

securing an upper elastic plate having an upper cutting protuberance formed thereon to the moving part of a press machine at a predetermined position positionally coincident with the foregoing predetermined position, said upper cutting protuberance being formed to exhibit the same or substantially the same contour as that of said lower cutting protuberance; and operating said press machine to cut said stone based material by bringing said upper cutting protuberance of said upper elastic material in compressing contact with said lower cutting protuberance of said lower elastic plate.

2. A method of cutting a stone based material as claimed in claim 1, wherein in that said lower cutting protuberance and said upper cutting protuberance exhibit a square contour, respectively.

3. A method of cutting a stone based material as claimed in claim 1, wherein in that said lower cutting protuberance and said upper cutting protuberance exhibit a circular contour, respectively.

4. A method of cutting a stone based material as claimed in claim 1, wherein in that said lower cutting protuberance and said upper cutting protuberance exhibit a rhombic contour, respectively.

5. A method of cutting a stone based material as claimed in claim 1, wherein in that said lower cutting protuberance and said upper cutting protuberance exhibit an elliptical contour, respectively.

6. A method of cutting a stone based material as claimed in claim 1, wherein in that said lower cutting protuberance and said upper cutting protuberance exhibit a bird-like contour, respectively.

7. A method of cutting a stone based material as claimed in claim 1, wherein in that said lower cutting protuberance and said upper cutting protuberance exhibit a bullet-like contour, respectively.

8. A method of cutting a stone based material as claimed in claim 1, wherein in that said lower cutting protuberance and said upper cutting protuberance exhibit a sector-like contour, respectively.

9. A method of cutting a stone based material as claimed in claim 1, wherein in that said lower cutting protuberance and said upper cutting protuberance exhibit a wavy elongated rectangular contour, respectively.

10. A method of cutting a stone based material as claimed in claim 1, wherein in that said lower cutting protuberance and said upper cutting protuberance exhibit an octagonal contour, respectively.

11. A method of cutting a stone based material as claimed in claim 1, wherein in that said lower cutting protuberance and said lower cutting protuberance exhibit a hexagonal contour, respectively.

12. A method of cutting a stone based material as claimed in claim 1, wherein in that a plurality of lower cutting protuberances and a plurality of upper cutting protuberances each having a contour same to or different from each other are formed on said lower elastic plate and said upper elastic plate.

13. An apparatus for cutting a stone based material, comprising: a press section; a pump unit; an electric control panel; a lower elastic cutting plate having a lower cutting wire having a lower cutting protuberance formed thereon to exhibit a desired contour which is removably secured to a lower protective plate for said lower cutting plate; and an upper elastic cutting plate having an upper cutting protuberance formed thereon to exhibit the same or the substantial same contour as that of said lower cutting protuberance which is removably secured to an upper protective plate for said upper cutting plate.

14. An apparatus for cutting a stone based material as claimed in claim 13, wherein in that said lower cutting protuberance and said upper cutting protuberance exhibit a square contour, respectively.

15. An apparatus for cutting a stone based material as claimed in claim 13, wherein in that said lower cutting protuberance and said upper cutting protuberance exhibit a circular contour, respectively.

16. An apparatus for cutting a stone based material as claimed in claim 13, wherein in that said lower cutting protuberance and said upper cutting protuberance exhibit a rhombic contour, respectively.

17. An apparatus for cutting a stone based material as claimed in claim 13, wherein in that said lower cutting protuberance and said upper cutting protuberance exhibit an elliptical contour, respectively.

18. An apparatus for cutting a stone based material as claimed in claim 13, wherein in that said lower cutting protuberance and said upper cutting protuberance exhibit a bird-like contour, respectively.

19. An apparatus for cutting a stone based material as claimed in claim 13, wherein in that said lower cutting protuberance and said upper cutting protuberance exhibit a bullet-like contour, respectively.

20. An apparatus for cutting a stone based material as claimed in claim 13, wherein in that said lower cutting protuberance and said upper cutting protuberance exhibit a sector-like contour, respectively.

21. An apparatus for cutting a stone based material as claimed in claim 13, wherein in that said lower cutting protuberance and said upper cutting protuberance exhibit a wavy elongated rectangular contour, respectively.

22. An apparatus for cutting a stone based material as claimed in claim 13, wherein in that said lower cutting protuberance and said upper cutting protuberance exhibit an octagonal contour, respectively.

23. An apparatus for cutting a stone based material as claimed in claim 13, wherein in that said lower cutting protuberance and said upper cutting protuberance exhibit a hexagonal contour, respectively.

24. An apparatus for cutting a stone based material as claimed in claim 13, wherein in that a plurality of lower cutting protuberances and a plurality of upper cutting protuberances each having a contour same to or different from each other are formed on said lower protective plate and said upper protective plate.

25. An apparatus for cutting a stone based material, comprising: a press section; a pump unit; an electric control panel; a lower elastic cutting plate having a lower cutting wire having a lower cutting protuberance formed thereon to exhibit a desired contour which is removably secured to a lower protective plate for said lower cutting plate; an upper elastic cutting plate having an upper cutting protuberance formed thereon to exhibit the same or the substantial same contour as that of said lower cutting protuberance which is removably secured to an upper protective plate for said upper cutting plate.

26. A method of cutting a stone based material, comprising the steps of:

placing on a platform a lower elastic plate having a lower cutting wire having a lower cutting protuberance formed thereon at a predetermined position, said lower cutting protuberance being formed to exhibit a desired contour;

placing on said lower elastic plate a stone based material to be cut;

securing an upper elastic plate having an upper cutting protuberance formed thereon to the moving part of a press machine at a predetermined position positionally coincident with the foregoing predetermined position, said upper cutting protuberance being formed to exhibit the same or substantially the same contour as that of said lower cutting protuberance; and operating said press machine to cut at least a portion of said stone based material so as to have at least a curve line by bringing said upper cutting protuberance of said upper elastic material in compressing contact with said lower cutting protuberance of said lower elastic plate.

27. An apparatus for cutting a stone based material, comprising: a press section; a pump unit; an electric control panel; a lower elastic cutting plate having a lower cutting wire having a lower cutting protuberance formed thereon to exhibit a desired contour which is removably secured to a lower protective plate for said lower cutting plate; an upper elastic cutting plate having an upper cutting protuberance formed thereon to exhibit the same or the substantial same contour as that of said lower cutting protuberance which is removably secured to an upper protective plate for said upper cutting plate.

28. A method of cutting a stone based material, comprising the steps of:

placing on a platform a lower elastic plate having a lower cutting wire having a lower cutting protuberance formed thereon at a predetermined position, said lower cutting protuberance being formed to exhibit a desired contour;

placing on said lower elastic plate a stone based material to be cut;

securing an upper elastic plate having an upper cutting protuberance formed thereon to the moving part of a press machine at a predetermined position positionally coincident with the foregoing predetermined position, said upper cutting protuberance being formed to exhibit the same or substantially the same contour as that of said lower cutting protuberance, each of said upper and lower cutting protuberances having a cross-section which is at least triangular or circular; and operating said press machine to cut said stone based material by bringing said upper cutting protuberance of said upper elastic material in compressing contact with said lower cutting protuberance of said lower elastic plate.

* * * * *